US006162274A

United States Patent [19]

Kamikawa et al.

[11] Patent Number: 6,162,274

[45] Date of Patent: Dec. 19, 2000

[54] STEEL PRODUCTION METHOD

[75] Inventors: Susumu Kamikawa; Hisao Teramoto; Shigeo Itano, all of Hiroshima, Japan

[73] Assignee: Mitsubishi Heavy Industries, Ltd., Tokyo, Japan

[21] Appl. No.: 09/333,665

[22] Filed: Jun. 16, 1999

[30] Foreign Application Priority Data

Jul. 17, 1998 [JP] Japan ..... 10-204076

[51] Int. Cl.[7] ..... C21B 13/12

[52] U.S. Cl. ..... 75/10.1; 75/10.63; 75/10.66

[58] Field of Search ..... 75/10.1, 10.63, 75/10.66, 500

[56] References Cited

U.S. PATENT DOCUMENTS 4,490,168 12/1984 Formanek et al. ..... 75/10.12

FOREIGN PATENT DOCUMENTS 0 117 928 9/1984 European Pat. Off. .

*Primary Examiner*—Roy V. King
*Assistant Examiner*—Tima McGuthry-Banks
*Attorney, Agent, or Firm*—Oblon, Spivak, McClelland, Maier & Neustadt, P.C.

[57] ABSTRACT

A steel production method including preparing reduced iron pellets, taking a first portion of the reduced iron pellets and charging the first portion of the reduced iron pellets in a submerged electrical arc furnace such that a sufficient amount of hot metal is produced to efficiently melt and charge a second portion of the reduced iron pellets in an electrical arc furnace, and melting and charging the second portion of reduced iron pellets in the electrical arc furnace, thereby producing steel, wherein the first and second portions of the reduced iron pellets have a ratio between 30 to 70 wt. %.

1 Claim, 7 Drawing Sheets

10:THE REDUCED IRON PELLETS
11:THE SUBMERGED ARC FURNACE
12:THE HOT METAL
13:THE ELECTRICAL ARC FURNACE
14:THE STEEL

10: THE REDUCED IRON PELLETS
11: THE SUBMERGED ARC FURNACE
12: THE HOT METAL
13: THE ELECTRICAL ARC FURNACE
14: THE STEEL

STEEL PRODUCTION METHOD

BACKGROUND OF THE INVENTION

1. Field of the Invention

The present invention relates to a steel manufacturing method wherein steel is manufactured by an electric arc furnace using reduced iron pellets as the principal material.

2. Description of the Related Art

As a method for manufacturing steel using reduced iron pellets as the principal raw material, as shown in FIG. 3, charging reduced iron pellets 1 in an electric arc furnace 2 to produce a steel by smelting has been proposed. In this case, because the reduced iron pellets 1 which are the raw material include almost no metal impurities such as Cu, Sn, or Ni, it can be said that there are a superior raw material when the objective is to obtain pure Fe.

In addition, as an applied example of the above method, as shown in FIG. 4, there is also a method wherein scrap 4 is used together with the above reduced iron pellets 1 to manufacture the steel 3. The reason for introducing this scrap 4 is to avoid the disadvantages that the Fe yield decreases, amount of slag produced increases, and the electricity consumption increases due to the melting requiring a long time, because the reduced iron pellets 1 incorporate a large silicon component (SiO2, etc.) and unreduced FeO which forms slag. FIGS. 5~7 show how the Fe yield, amount of slag production, and electrical consumption change when the use ratio of reduced iron pellets 1 to the scrap 4 is increased. From these figures, it is clear that when the amount of scrap 4 is large, each of the above problems are ameliorated (FIGS. 5~7 are quoted from materials distributed at a conference in Jamshadpur, India, Jan. 11~13, 1996, "Alternative Routes to Iron and Steel").

Furthermore, although not a method wherein reduced iron pellets 1 are used as the principal iron component, as shown in FIG. 8, by using the hot metal 6 removed from a blast furnace 5 along with this scrap 4, a steel 3 is produced in an electric arc furnace. This is known as a method which aims at diluting the impurities that accompany melting only scrap 4, shortening the melting time, and lowering electrical power for melting.

However, in the above methods, there are the following types of problems. First, a method for producing steel by using only reduced iron pellets, as has already been described above, cannot be said to be desirable because it entails the problems such as Fe yield decreasing, the amount of slag produced increasing, and electrical power consumption, increasing, etc., due to the existence of silicone components, beginning with the SiO2 included in this reduced iron pellets, and the FeO, etc., which are included at 5~10 wt. %.

In addition, when using reduced iron pellets and scrap together, in the smelting of the Cu, Sn, and Ni, etc., in this scrap, elements which cannot be eliminated are included, and thus in the steel produced in the electrical arc furnace, it is impossible to avoid a state where these impurities are mixed in. When these types of impurities are included in the steel, this entails degrading of the product quality, such as impairing the workability of the steel.

Furthermore, when using hot metal derived from the blast furnace and scrap, there is the problem that a blast furnace is necessary to carry this out. However, in providing a new blast furnace, large equipment investment is necessary, and this is not practical. That is, this method can be said to be effective only in a location there a blast furnace is already installed. In addition, even in this method, there is no difference in the above- described use of scrap, and thus even though diluted, the impurities mixed into the steel are in the end a problem.

In consideration of the above- described problems, it is an object of the present invention to provide a steel production method to obtain at a low cost an iron material which is pure and gives superior workability to the produced the steel.

SUMMARY OF THE INVENTION

The present invention provides the following means for solving the above-mentioned problems.

The steel production method is characterized by including the steps of: charging one part of the reduced iron pellets which are the raw material in a submerged electrical arc furnace and producing hot metal; charging said hot metal in an electrical arc furnace and forming a pool of said hot metal; and charging the remaining reduced iron pellets which are said raw material in said pool and producing steel.

According to this method, by a submerged furnace which can support a reducing atmosphere, the steel is produced from hot metal obtained by the remaining unreduced Fe(FeO) in the reduced iron pellets being reduced and the reduced iron pellets not including any metal impurities such as Cu, Sn, Ni, etc., from the beginning. Therefore, it is possible to produce steel providing a high purity and superior qualities.

The steel production method recited in claim 1 is characterized in the remainder of the reduced iron pellets which are the raw material charged in said electrical arc furnace using 30~70 wt. % as a whole of said reduced iron pellets which are the raw material.

According to this method, in consideration that both the case of producing steel by charging all reduced iron pellets in an electrical arc furnace, and inversely, the case of all the reduced iron pellets being charged in a submerged arc furnace and made melted metal and subsequently producing the steel in the electrical arc furnace, are methods which entail production costs, the separation of the reduced iron pellets as described above are the method which make possible the production of steel having superior qualities at a low cost.

EXPLANATION OF THE REFERENCE NUMBERS

10 reduced iron pellets

11 submerged arc furnace

12 hot metal

13 electrical arc furnace

14 molten steel

DESCRIPTION OF PREFERRED EMBODIMENTS

Figure 1:
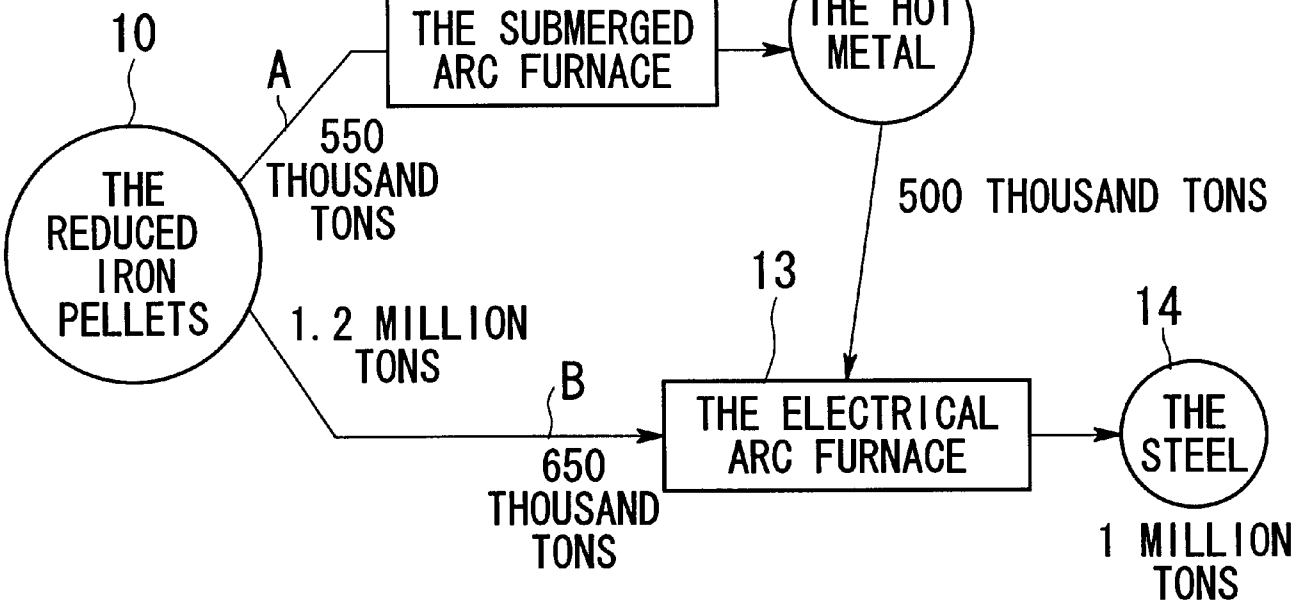
FIG. 1 is an explanatory diagram schematically showing an example of a steel production method.

Below a preferred embodiment of the present invention is explained with reference to the figures. FIG. 1 is an explanatory diagram schematically showing an example of the production method of a steel 14 according to the present invention. Among the items shown in FIG. 1, the electrical arc furnace 13, as is well known, produces an arc between the raw material charged in the furnace and electrodes, and the raw material is melted using this high temperature. Moreover, the electrical arc furnace 13 in the present embodiment is provided with a melting capacity of about 130 t/heat.

In addition, the submerged arc furnace 11 has an electrode buried in the charged material, and by passing electricity through it, smelting takes place in a smelting zone around said electrode. This is generally known as a furnace used when carrying out reduction of an oxide by carbon. Therefore, when smelting, a large amount of CO gas is continuously produced, but because this CO can be easily removed from the reaction system, the reaction easily reaches completion, and its productivity is high. This kind of submerged arc furnace maintains a reducing atmosphere in the furnace. In addition, the production of hot metal is possible, and at the same time operation is possible at a low temperature of about 1500° C. in the metal fusion temperature in the furnace in comparison with the operation temperature (about 1600~1700° C.) in the electrical arc furnace 13. Incidentally, that the operation temperature is low means having the advantage that there is almost no consumption of the refractory in the furnace.

The above-described electrical arc furnace and submerged furnace, as shown in FIG. 1, are connected by a line wherein the hot metal 12 derived from the submerged furnace 11 flows to the electrical arc furnace 13. Moreover, a hot metal caldron for temporarily stocking hot metal 12 is provided between the submerged arc furnace 11 and the electrical arc furnace 13. In addition, the reduced iron pellets 10 which are the raw material can be charged in both the electrical arc furnace 13 and the submerged arc furnace 11, and lines A and B for this are provided as equipment.

Below, the method of actually producing a molten steel 14 using the equipment having the above-described structure is explained. Moreover, in the present embodiment, the explanation is made under the assumption that 1 million tons of molten steel 14 are produced per year. However, these numerical limitations have no essential significance for the present embodiment.

First, from the above assumption, in the present embodiment, 1.2 million tons of the reduced iron pellets 10 is prepared. Among this 1.2 million tons of reduced iron pellets, one part is charged in the submerged arc furnace 11. Here, for example, this part is set at 550 thousand tons. Thus 500 thousand tons of hot metal are produced. This hot metal is intermittently discharged from the submerged arc furnace at a temperature of about 1500° C. and received into the hot metal caldron. In addition, the amount of incorporated Cu in this hot metal 12 is about 3%. Moreover, the electrical capacity of the submerged arc furnace in this case is about 35 MW.

The hot metal 12 produced in this manner is next conveyed to the electrical arc furnace 13. In the electrical arc furnace 13, a pool of this hot metal 12 is formed. Subsequently, electrodes are set and an electrical current passed, and at the same time, through line B in FIG. 1, the reduced iron pellets 10 which are the raw material is continuously charged and melted in this pool, that is, in the electrical arc furnace 13. This amount is about 650 thousand tons, since 550 thousand tons of the total 1.2 million tons of reduced iron pellets 10 are charged in the submerged arc furnace 11.

Here, as described above, in the case of dividing the reduced iron pellets 10 between the submerged arc furnace 11 and the electrical arc furnace 13, the inventors have ascertained that there is a suitable range with respect to this division. This can be deduced from the production cost curve shown in FIG. 2. In this figure, the abscissa is the ratio of the reduced iron pellets 10 directly charged in the electrical arc furnace 13 to the total raw material (the total reduced iron pellets 10), and the ordinate is the production cost. Moreover, the production cost corresponding to each case on the abscissa is shown as a ratio with respect to '1', which is the production cost incurred in the case of all the combined reduced iron pellets being charged in the electrical arc furnace.

Figure 2:
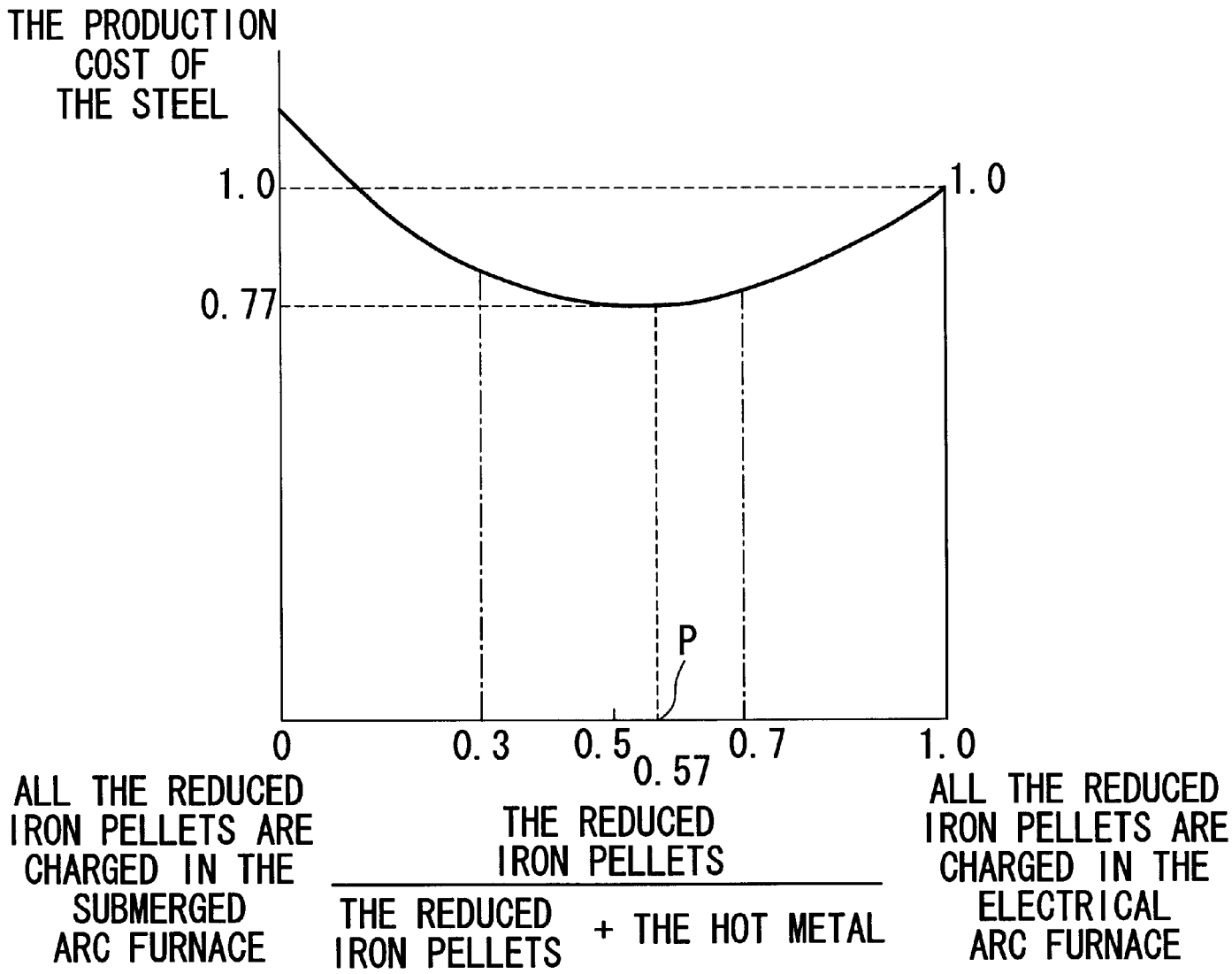
FIG. 2 is a graph showing how the production cost curve of steel changes when the mixture ratio of the reduced iron pellets charged in the electrical arc furnace and the hot metal is changed.
Figure 3:
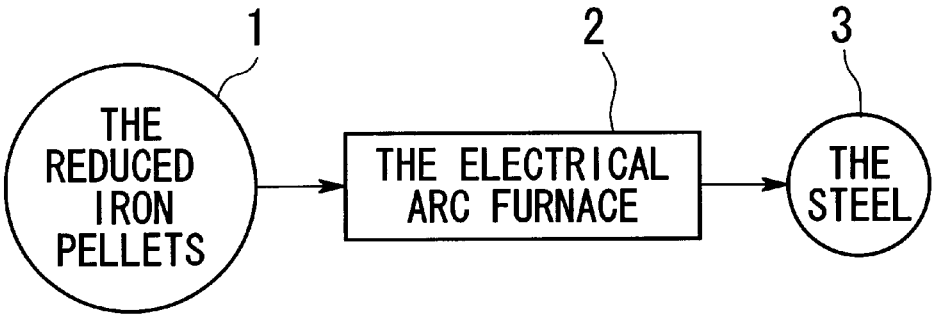
FIG. 3 is an explanatory diagram schematically showing the conventional steel production method.
Figure 4:
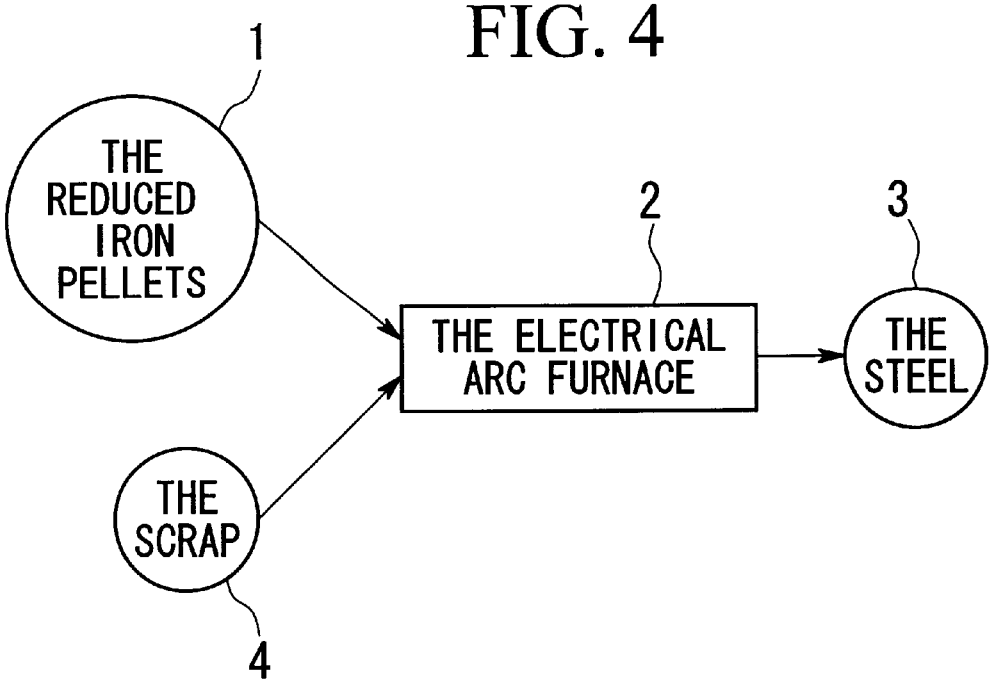
FIG. 4. is an explanatory diagram schematically showing a conventional steel production method different from that in FIG. 3.
Figure 5:
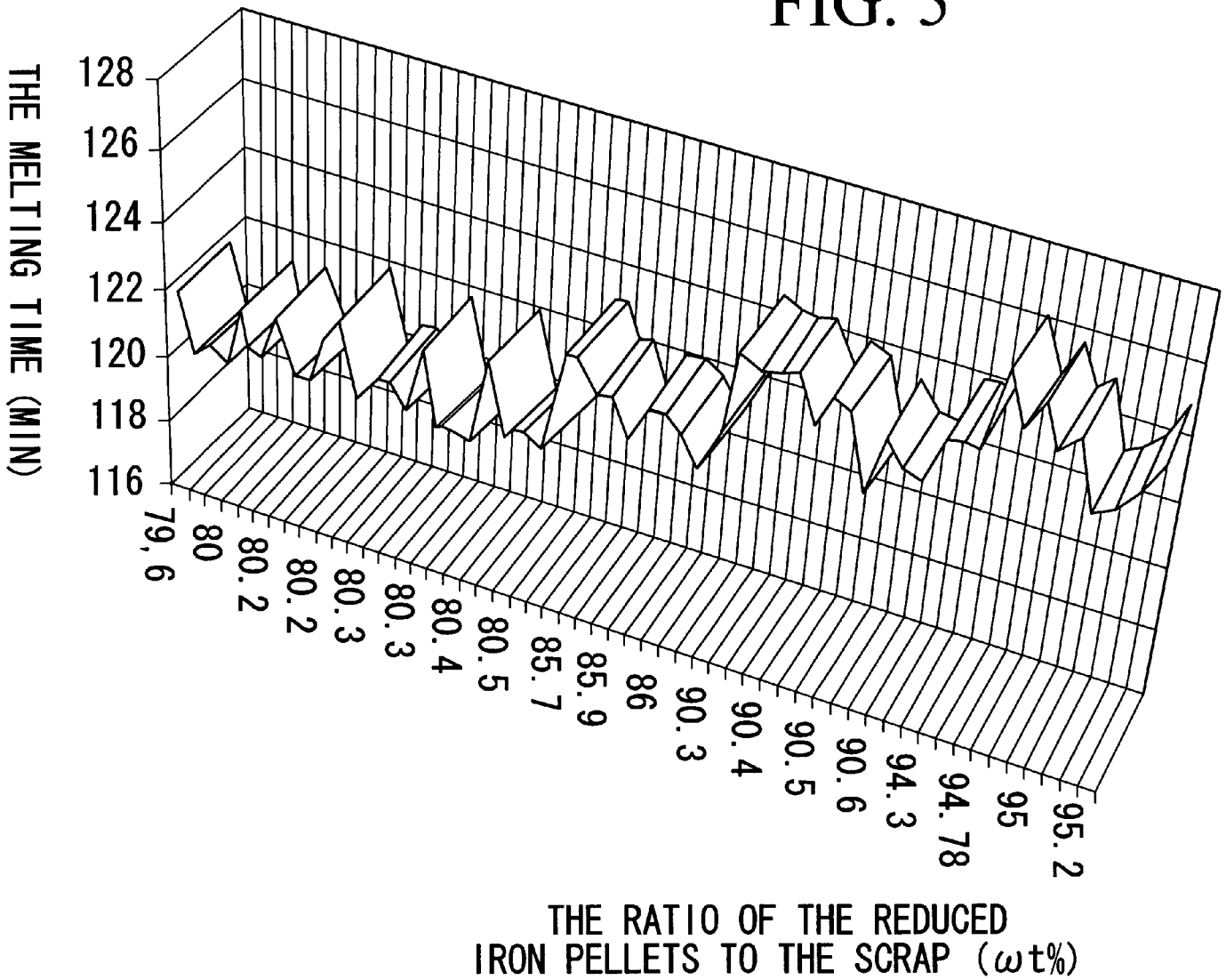
FIG. 5 is a graph showing how the melting time changes when the ratio of the reduced iron pellets charged in an electrical arc furnace and the scrap is changed.
Figure 6:
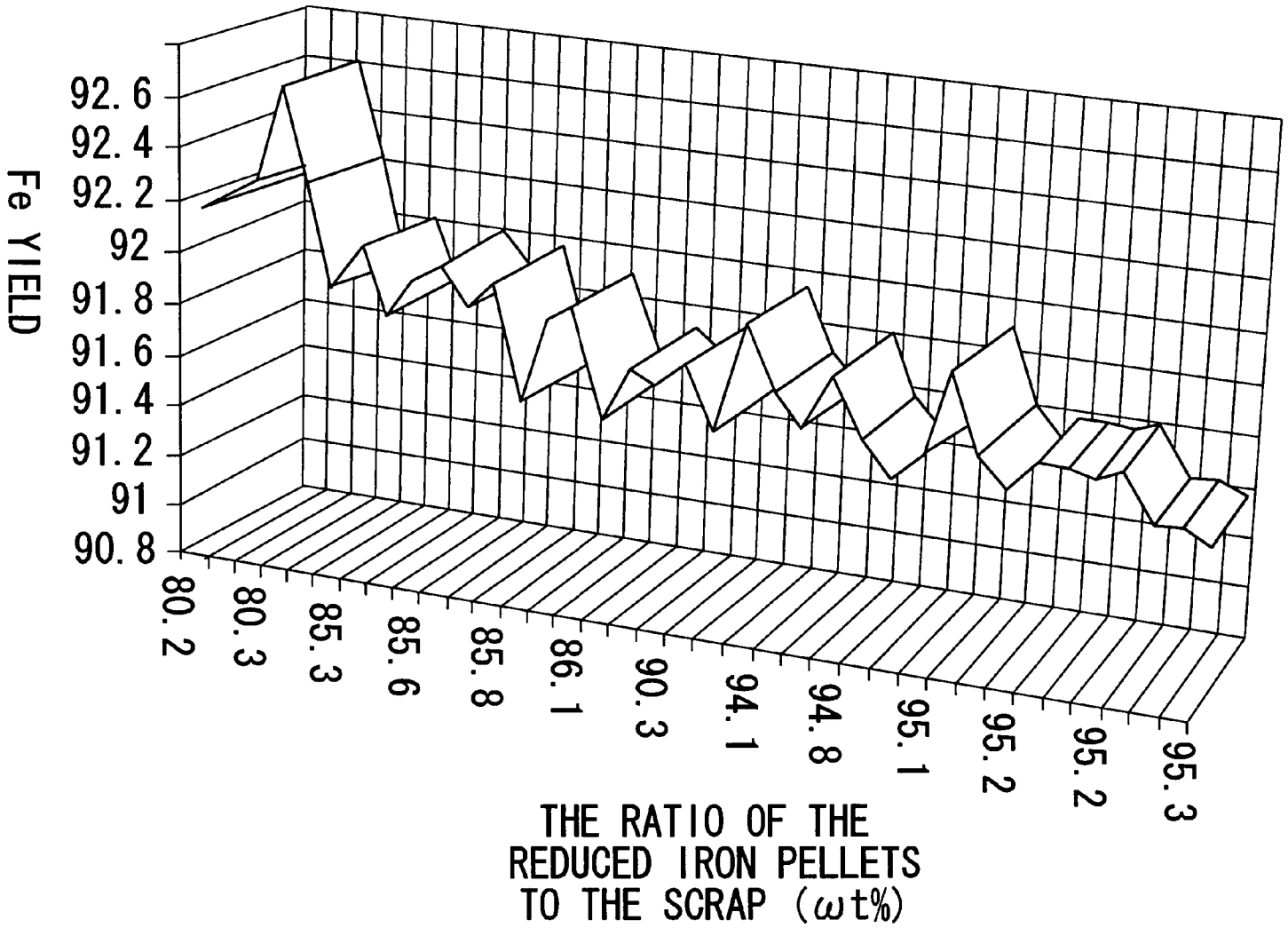
FIG. 6 is a graph showing how the Fe yield changes when the ratio of the reduced iron pellets charged in an electrical arc furnace and the scrap is changed.
Figure 7A:
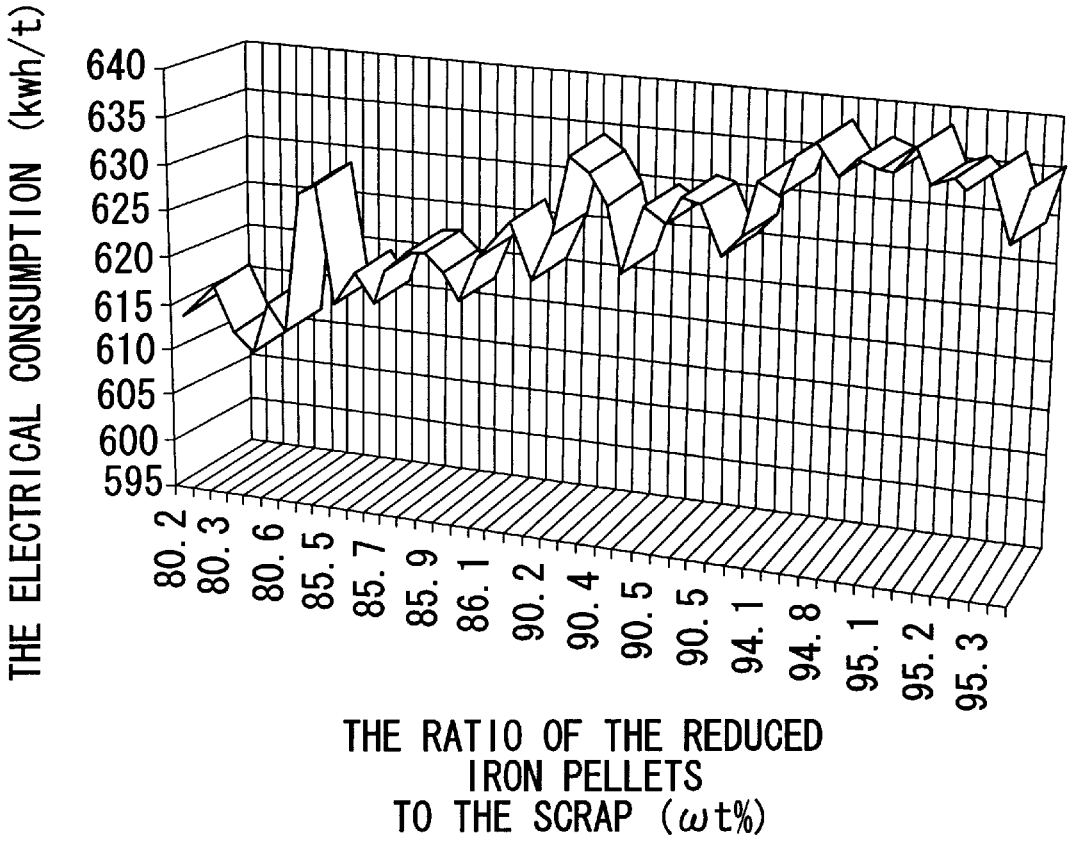
FIG. 7 is a graph showing how the amount of the consumption of electricity changes when the ratio of the reduced iron pellets charged in an electrical arc furnace and the scrap is changed; (a) and (b) are, respectively, two examples.
Figure 7B:
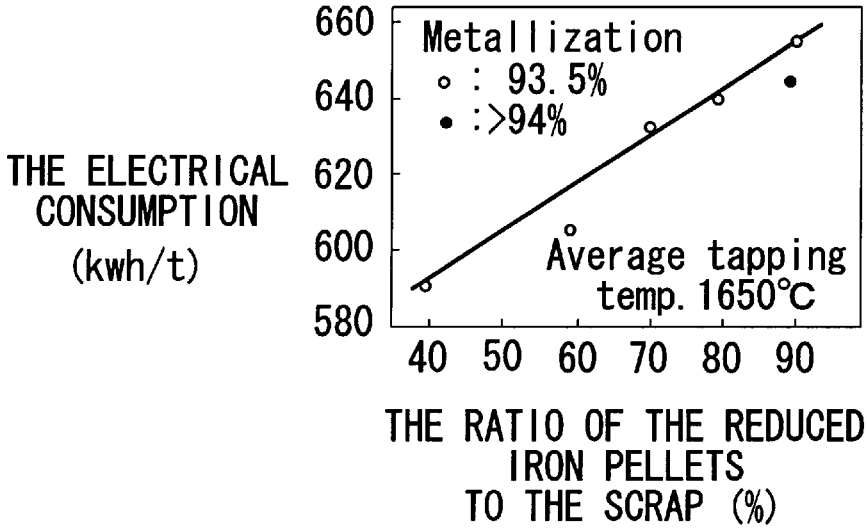
Figure 8:
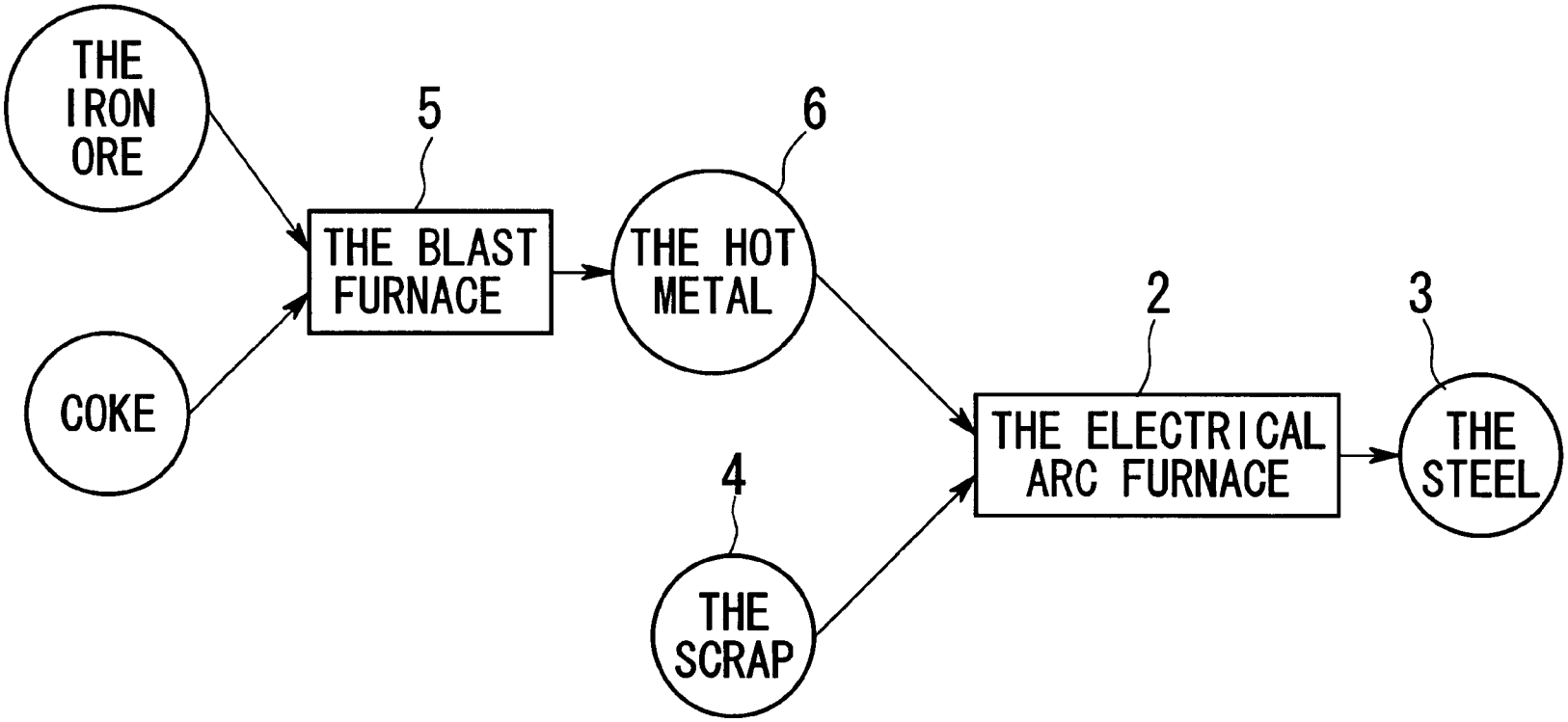
FIG. 8 is an explanatory diagram schematically showing a conventional steel production method different from that in FIG. 3 and FIG. 4.

From this FIG. 2, it is clear that the curve of the production cost defines a second degree curve which is convex downward. The left axis of the figure is the case when all the reduced iron pellets 10 are charged in the submerged arc furnace 11, but in this case, it is necessary to make the capacity of this submerged arc furnace very large, and installation charge increases, and next when smelting in the electrical arc furnace 13, due to the decarbonization (oxidizing elimination of the carbon component in the hot metal 12) time being long, etc., the production cost is increased, and thereby, the appearance of the curve. In addition, the right axis in the figure is the case of all the reduced iron pellets being charged directly in the electrical arc furnace 13, and the fact that a large amount of electricity is required has already been explained in the section on related art (refer to FIG. 7, (*a*) and (*b*)). In conclusion, it is clear from this production cost curve that the lowest cost is when the ratio of the reduced iron pellets 10 directly charged in the electrical arc furnace 13 to the total raw material (the total reduced iron pellets) is about 30~70 wt. %.

Therefore, to return to the case of the present embodiment shown in FIG. 1, the ratio of reduced iron pellets 10 directly charged in the electric arc furnace 13 to the total reduced iron pellets of the raw material is about 57%, derived from 650 thousand tons/1.2 million tons. In FIG. 2, this is the part shown by the reference letter P. Thus, the production cost of steel in this case is 77% in comparison to the production cost of steel when produced by melting and smelting the reduced iron pellets 10 only in the electrical arc furnace 13, and this corresponds to a 23% cost reduction.

The hot metal 12 and the reduced iron pellets 10 in the electrical arc furnace 13 are discharged as a molten steel 14 at about 1650° C. In Chart 1, the composition related to the produced molten steel 14 is shown.

CHART 1

| | C | Si | Mn | P | S | Cu | Sn | Ni |
|---|---|---|---|---|---|---|---|---|
| present embodiment | 0.13 | 0.20 | 0.67 | 0.020 | 0.025 | 0.01 | 0.001 | 0.02 |
| conventional art | 0.13 | 0.18 | 0.70 | 0.019 | 0.026 | 0.2 | 0.02 | 0.08 |

As can be understood from Chart 1, in comparison with steel produced by the conventional art, in the present embodiment, the produced steel 14 has extremely small amounts of the metal element impurities Cu, Sn, and Ni. Cu, Sn, etc., are known to impair the workability of steel seriously, so on this point, steel 14 of the present embodiment produces a steel of better quality and purity than steel produced by the conventional art.

In this manner, steel production method in the present embodiment, if necessary, can produce hot metal 12 by charging a part of the reduced iron pellets 10, which are the raw material, into the submerged arc furnace 11, and by smelting this and the remainder of the reduced iron pellets 10 in an electrical arc furnace 13, can obtain steel 14. In addition, according to this method, as is clear from what has been described above, it is possible to attain the effect of producing inexpensively a high quality steel 14 that includes almost harmful impurities.

In addition, by using a submerged arc furnace 11, the unreduced FeO included in the reduced iron pellets 10 which are the raw material is reduced by the high temperature reducing atmosphere in the furnace, and because it is converted to useful metal Fe, it is worth noting that the Fe yield (the Fe component in the hot metal 12/Fe component in the reduced iron pellets 10) is greatly increased. That is, using the submerged arc furnace 11 can be said to be advantageous on this point. Furthermore, its operational temperature is low compared to the electrical arc furnace 13, and thus the energy necessary for fusion of the silicone component($SiO_2$) to be eliminated, that is, the amount of electrical power, is decreased. These are important factors in making the above effects feasible.

Moreover, in the above- described embodiment, although not shown in FIG. 1, when it is possible to secure high quality, inexpensive scrap, such as scrap produced on site, by charging it along with the hot metal 12 and the reduced iron pellets 10 in the electrical arc furnace 13, it is possible to produce a steel 14. Incidentally, the high quality mentioned above means that the amounts of metal element impurities such as Cu, Sn, and Ni is extremely small.

In addition, the present invention is not particularly limited with respect to the form of more specific steel production equipment for applying the above- described steel production method. That is, for example, with respect to the electrical arc furnace 13, the above description was to the effect that its melting capacity was 130 t/heat, but the present invention is not limited in this respect. Also, in electrical arc furnaces and submerged arc furnaces, etc., having the same operation and function but various forms (for example, capacity, etc.) already proposed, it is clear that it is not necessary to limit the present invention to this specific form.

As described above, steel production method of recited in claim 1 is characterized in including the steps of charging one part of the reduced iron pellets which are the raw material in a submerged electrical arc furnace and producing hot metal, and charging the remaining reduced iron pellets which are said raw material in an electrical arc furnace to produce a melt, and thereby it is possible to produce a melt having high purity, ease of workability, and superior quality.

In addition, steel production method recited in claim 2 is characterized in the remainder of the reduced iron pellets which are the raw material charged in said electrical arc furnace using 30~70 wt. % as a whole of said reduced iron pellets which are the raw material, and thereby it is possible to provide at low cost a melt having superior quality.

What is claimed is:

1. A steel production method comprising the steps of:

preparing reduced iron pellets;

taking a first portion of said reduced iron pellets and charging said first portion of said reduced iron pellets in a submerged electrical arc furnace such that a sufficient amount of hot metal is produced to efficiently melt and charge a second portion of said reduced iron pellets in an electrical arc furnace; and melting and charging said second portion of reduced iron pellets in the electrical arc furnace, thereby producing steel, wherein said first and second portions of the reduced iron pellets have a ratio between 30 to 70 wt. %.

* * * * *